US005785997A

United States Patent [19]

Büdenbender et al.

[11] Patent Number: 5,785,997

[45] Date of Patent: Jul. 28, 1998

[54] CONTINUOUS PROCESS FOR MELT-SPINNING MONOFILAMENTS

[75] Inventors: Jürgen Büdenbender; Eckhard Gärtner; Jakob Jansen, all of Dormagen, Germany

[73] Assignee: Bayer Aktiengesellschaft, Leverkusen, Germany

[21] Appl. No.: 597,315

[22] Filed: Feb. 6, 1996

Related U.S. Application Data

[62] Division of Ser. No. 322,233, Oct. 13, 1994, Pat. No. 5,518,670.

[30] Foreign Application Priority Data

Oct. 22, 1993 [DE] Germany ..... 43 36 097.1

[51] Int. Cl.[6] ..... D01D 5/088

[52] U.S. Cl. ..... 425/71; 425/67; 425/68; 264/178 R; 264/210.8

[58] Field of Search ..... 425/67, 68, 69, 425/70, 71, 72.2; 264/178 R, 160, 210.8, 210.3, 103

[56] References Cited

U.S. PATENT DOCUMENTS

| | | | |
|---|---|---|---|
| 2,746,839 | 5/1956 | Terry et al. | 425/67 |
| 2,875,019 | 2/1959 | Spohn et al. | 264/178 |
| 2,895,790 | 7/1959 | Brown et al. | 425/70 |
| 3,002,804 | 10/1961 | Kilian | 264/178 F |
| 3,029,124 | 4/1962 | Farrow | 264/178 |
| 3,041,663 | 7/1962 | Green | 425/66 |
| 3,091,805 | 6/1963 | Dusenbury | 425/66 |
| 3,126,434 | 3/1964 | Berger, Jr. | 425/66 |
| 3,156,750 | 11/1964 | Cuculo | 264/342 |
| 3,221,088 | 11/1965 | Martin | 425/66 |
| 3,259,681 | 7/1966 | Bull et al. | 264/210.3 |
| 3,511,677 | 5/1970 | Strohmaier et al. | 264/210.3 |
| 3,512,214 | 5/1970 | Shiba et al. | 425/66 |
| 3,518,722 | 7/1970 | Ryan et al. | 264/178 F |
| 3,621,088 | 11/1971 | Hatcher et al. | 264/210.8 |
| 3,790,655 | 2/1974 | Cramton | 264/103 |
| 3,946,094 | 3/1976 | Kanetsuna et al. | 264/210.8 |
| 3,993,805 | 11/1976 | Roberts | 264/178 |
| 4,265,849 | 5/1981 | Borenstein | 264/103 |
| 4,451,422 | 5/1984 | Yui et al. | 264/210.8 |
| 4,627,804 | 12/1986 | Kobayashi et al. | 425/69 |
| 5,019,316 | 5/1991 | Ueda et al. | 264/210.8 |
| 5,171,504 | 12/1992 | Cuculo et al. | 264/178 F |
| 5,362,430 | 11/1994 | Herold, II et al. | 264/178 |

FOREIGN PATENT DOCUMENTS

| | | |
|---|---|---|
| 4129521 | 3/1993 | Germany . |
| 9111547 | 8/1991 | WIPO . |

OTHER PUBLICATIONS

Handbuch der Kunststoff–Extrusionstechnik II, Hanser Verlag, pp. 295–319 (1986).

*Primary Examiner*—Jay H. Woo
*Assistant Examiner*—Minh-Chau T. Pham
*Attorney, Agent, or Firm*—Sprung Kramer Schaefer & Briscoe

[57] ABSTRACT

The invention relates to a continuous process for the formation of monofilaments having a diameter of from 60 μm to 500 μm from filament-forming polymers by melt-spinning the polymer, optionally quenching the formed polymer filaments below the melt-spinning head with a cooling medium, cooling the filaments in a liquid bath having a temperature of from −10° C. to 150° C., removing the entrained water and post-treating the filaments by spin finishing, drawing and fixing at a filament delivery speed which is greater than 600 to 4000 m/min after the fixing step.

5 Claims, 4 Drawing Sheets

CONTINUOUS PROCESS FOR MELT-SPINNING MONOFILAMENTS

This is a division of application Ser. No. 08/322,233, filed on Oct. 13, 1994 , U.S. Pat. No. 5,518,670.

The invention relates to a high-speed production process for the formation in continuous manner of monofilaments having diameter of from 60 μm to 500 μm from filament-forming polymers, by melt-spinning the polymer, optionally quenching the formed polymer filaments below the melt-spinning head with a cooling medium, cooling the filaments in a liquid bath having a temperature of from −10° C. to 150° C., removing the entrained water and post-treating the filaments by finishing, drawing and fixing, with the delivery speed of the filaments after the fixing step being greater than 600 to 4000 m/min.

BACKGROUND OF THE INVENTION

Processes for the formation and further treatment of monofilaments are fundamentally known. The known process steps are described in detail in the Handbuch der Kunststoff-Extrusionstechnik [Manual of Plastics Extrusion Technology] II, Carl Hanser Verlag Munich, Vienna, 1986, pp. 295 to 319. According to this source, thermoplastic monofilaments (having a diameter greater than 60 μm) may be produced by spinning, for example in water, at a maximum delivery speed of 600 m/min.

Monofilaments of substantially smaller cross section and multifilaments are spun directly in air at a markedly greater delivery speed using different processes. Thus, German Offenlegungsschrift DE 41 29 521 A1 describes an apparatus for high-speed spinning of multifilaments at winding speeds of at least 2000 m/min., in particular at least 5000 m/min.

By contrast with the process according to the invention, multifilaments are in this case spun in air and wound directly. A particular feature of this patent is the cooling device. It comprises a porous tube which is open in the direction of spinning and is disposed concentrically to the spinning line. The high winding speeds obviate the need for active supply of a cooling medium. The process described therein relates to filament yarns having single filament titres of from 0.1 to 6 dtex, and is not applicable to monofilaments of a diameter greater than 50 μm (approx. 20 dtex).

International Application WO 91/11547 discloses a process and an apparatus for high-speed spinning of monofilaments having a single titre of from 1 to 30 dtex (corresponding to approx. 10 to 55 μm). The melt-spun monofilaments are in this case cooled with blown air, drawn over a friction element, provided with a spin finish and wound onto bobbins at a speed of up to 6000 m/min. This process differs from the process according to DE 41 29 521 A1 only in terms of the active cooling of the monofilaments by blown air and in the friction element by way-of which the filament tension is influenced.

Both direct spinning-stretching processes (DE 41 29 521 A1 and WO 91/11547) are as a matter of principle restricted to small monofilament diameters (Ø<55 μm) by the unfavourable nature of heat removal resulting from air cooling and poor internal thermal conduction in the wire.

The object of the present invention is to provide a continuous process for melt-spinning monofilaments having a diameter of from 60 to 500 μm from filament-forming polymers, in particularly polyamide, in which spinning takes place in a cooling bath and which, despite the high delivery speed of from 600 to 4000 m/min, is still controllable, in particular while passing through the cooling bath, and which affords a filament quality at least comparable to that of the production processes known hitherto (at a delivery speed of from 200 to 400 m/min; see Handbuch der Kunststoffextrusionstechnik II, Hanser-Verlag (1989) atents, Knapp, Hensen Chapter 10).

SUMMARY OF THE INVENTION

The object is achieved according to the invention in that the filament-forming polymer is melt-spun in air; the spun filaments are cooled and deflected in a liquid bath having a temperature of from −10° to 150° C., with optional steadying of the fluid flow caused by the drag flow of the filaments; entrained water is removed from the filaments by wiping and/or throwing off, and the filaments are post-treated by optionally finishing, drawing and fixing. The filaments are then wound, with the filament delivery speed being at least 600 to 4000 m/min.

The subject of the invention is a continuous process for the formation of monofilaments having a diameter of from, 60 μm to 500 μm, preferably from 100 to 300 μm, by melt spinning the polymer, optionally quenching the formed polymer filaments below the melt-spinning head with a cooling medium, cooling the filaments in a liquid bath having a cooling liquid temperature of from −10° C. to 150° C., deflecting the filaments in the liquid bath at a filament guide, optionally steadying the fluid flow in the liquid bath caused by the drag flow of the filaments, wiping and throwing off the entrained fluid at the liquid bath outlet, removing by suction the residual entrained fluid, optionally applying a finish, drawing in one or more stages in hot air, hot water or vapour or in a combination of the latter media, fixing the drawn filaments in hot air and/or vapour and subsequently winding the filaments, with the delivery speed of the filaments after the fixing step being from 600 to 4000 m/min, preferably from 1000 to 3500 m/min.

The polymer melt is spun in air from a spinning head which is known in principle. Any filament-forming polymers which may be melt-processed are fundamentally suitable for the purpose, in particular polyamide, polyester, polyethylene, polyphenylene sulphide, polypropylene and polyacrylonitrile. Of these, polyamides such as polyamide-6, polyamide-66, polyamide-12, polyamide-6/T, and copolyamides such as polyamide-66/6, polyamide-12/6, polyamide 11/6 and polyamide-6/10, and mixtures thereof are in particular suitable. Polyamide-6 having a solution viscosity $\eta_{rel}$ of from 2.8 to 4.4 as a 1% solution, measured in meta cresol at 25° C., is particularly preferred.

The polymer filaments formed are preferably quenched with temperature-controlled air at from 0° to 50° C., preferably from 10° to 25° C., delivered by blowing nozzles below the spinning head in lateral manner along a zone from 1 to 10 cm in length, in order to stabilise the smooth running of the filaments. The polymer filaments are then cooled in a liquid bath having a liquid tempeature of from −10° to 150° C., preferably from 10° to 40° C. While still in the liquid bath the filaments are deflected at a filament guidance from the vertical to the direction of the basin rim of the liquid bath. Formation of fluid flows in the liquid bath is preferably avoided by the installation of baffles.

Suitable cooling liquids for the liquid bath are any liquids which are inert to the filament polymers, such as for example water, oils (for example silicone oil), hydrocarbons, chlorocarbons, etc. The preferred cooling liquid for the liquid bath is water.

The entrained fluid carried from the cooling bath at the high processing speed is preferably wiped from the filaments with wipers and is thrown off at the liquid bath outlet on pull rollers. Residual entrained fluid is withdrawn from the filaments at a suction unit, and the filaments are then supplied to the further post-treatment steps. The first possible finishing which follows takes place in a manner which is known per se by applying to the filaments at the finish station an optionally aqueous finishing agent. Suitable finishes for this purpose are any lubricant dispersions based on, for example, natural and synthetic fats and ester oils, mineral oils, silicone oils, paraffin waxes, polyethylene or polypropylene waxes, condensates of fatty acids with polyalkylene polyamines and derivatives thereof, addition products of alkylene oxides and fatty alcohols, fatty amines or fatty acids and the like, organophosphoric acid esters, nonionic and anionic surfactants, etc.

The finishing step may also optionally take place after drawing or fixing.

The optionally finished filaments are then drawn by from 200 to 700% in one or more stages, preferably in from one to four stages, in hot air having a temperature of from 150° to 350° C., hot water having a temperature of from 85° to 98° C. or vapour having a temperature of from 100° to 150° C. or in any combination of the latter media, with the maximum degree of draw being determined by the drawability which is typical for the respective polymer.

The drawn filaments are then fixed in hot air having a temperature of from 150° to 350° C. and/or vapour having a temperature of from 100° to 150° C. and are then wound at a speed of from 600 to 4000 m/min, preferably from 1000 to 3500 m/min. A particular post finish (avivage) is preferably additionally applied at each bobbin station. Any lubricant dispersions based on, for example, natural and synthetic fats and ester oils, mineral oils, silicone oils, paraffin waxes, polyethylene or polypropylene waxes, condensates of fatty acids with polyalkylene polyamines and derivatives thereof, addition products of alkylene oxides and fatty alcohols, fatty amines or fatty acids and the like, organophosphoric acid esters, nonionic and anionic surfactants, etc. are suitable as the avivage.

BRIEF DESCRIPTION OF THE DRAWINGS

The invention is explained again by way of example with the aid of the Figures which follow and further sample embodiments, in which.

DETAILED DESCRIPTION OF THE DRAWINGS

Figure 1:
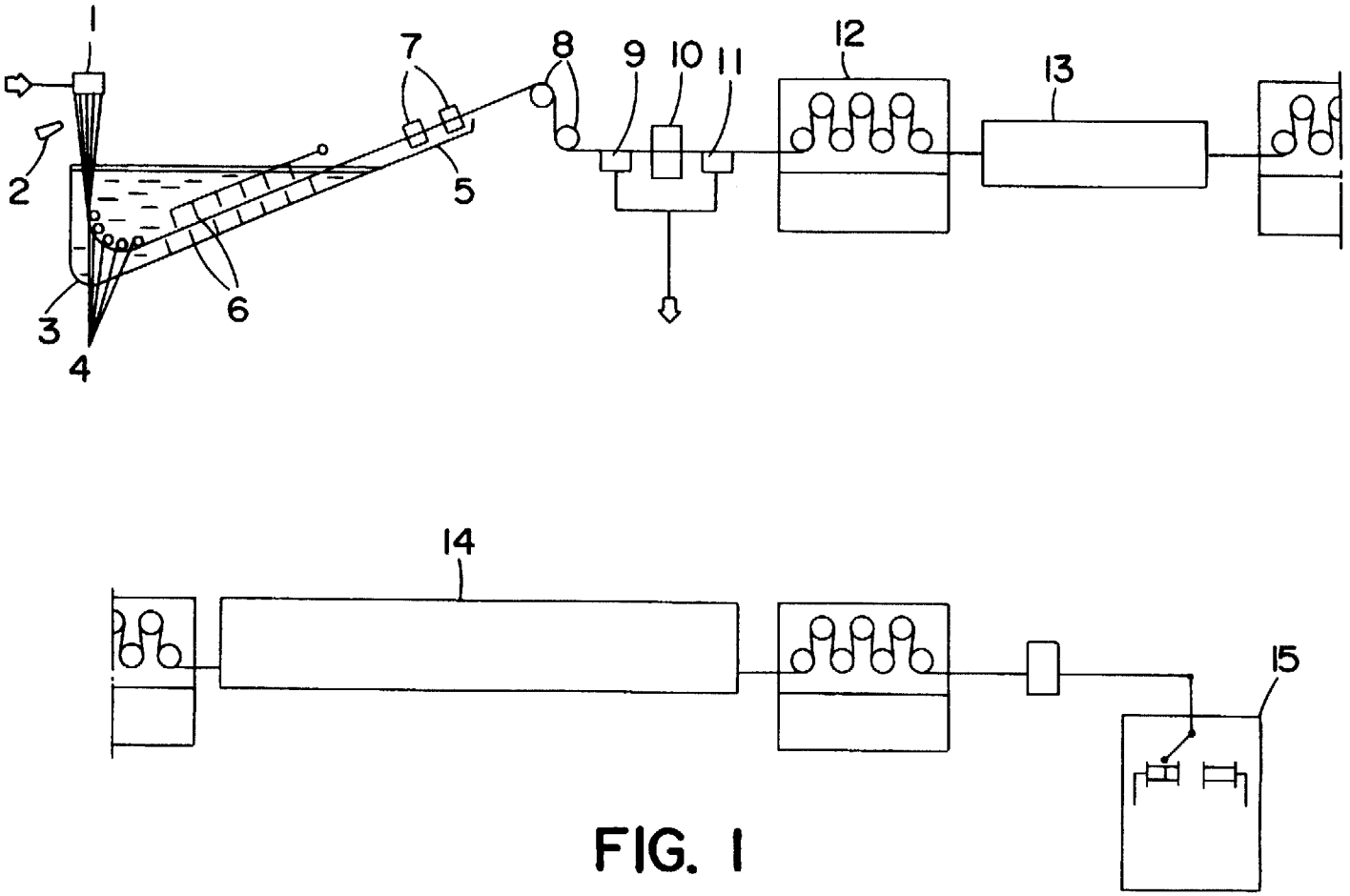
FIG. 1 shows a schematic diagram of the complete process.
Figure 2:
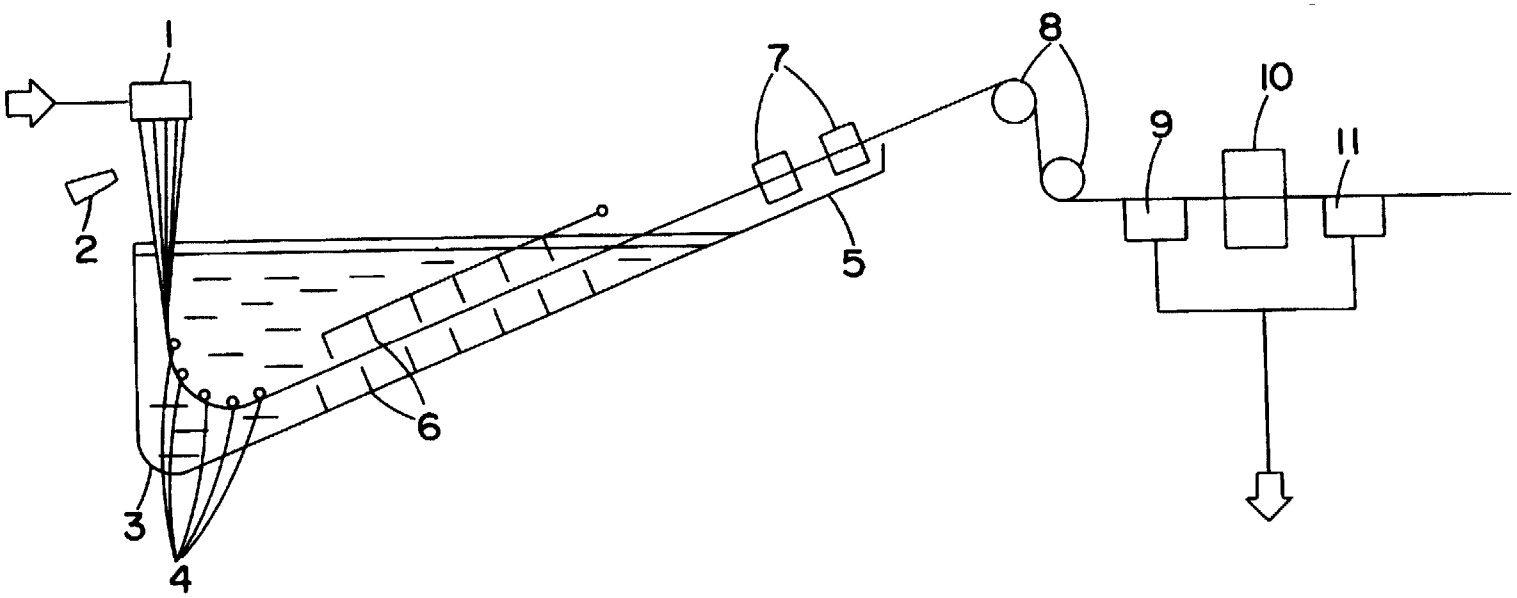
FIG. 2 shows the liquid bath according to the invention with filament guidance and baffles.

The polymer melt conveyed by conventional pumps (gear pumps) emerges at the annular spinneret 1 and is quenched with air at a temperature of from 0° to 50° C. from blowing nozzles 2, which flows through between the spinneret 1 and the cooling liquid (for example water). The filaments 17 become immersed in the liquid bath 3 and are deflected at the filament guidance 4 into the direction of the basin rim 5. The filament guidance 4 comprises rod-shaped guidance elements 4' of stainless steel or ceramic which are disposed in a semi-circle. The filaments are guided through so-called combs 16 in order to prevent collision and adhesion. It is important that friction between the filaments 17 and the filament guidance 4, and also the number of points of contact, be kept to a minimum.

Figure 3A:
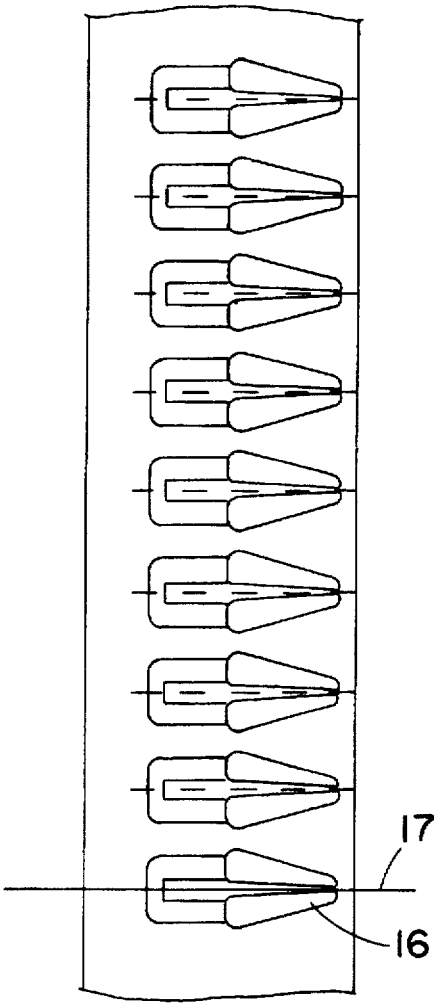
FIG. 3 shows the filament guidance according to the invention.
Figure 3B:
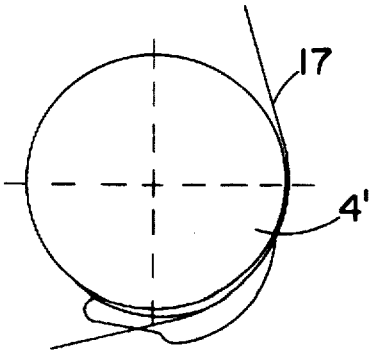

The specific filament guidance (FIG. 3) is a further subject of the invention. The guidance elements 4' of the filament guidance 4 are constructed such that at the high haul-off speed the filaments 17 slide over the guidance elements 4' through the entrained water—in a manner similar to the effect of a sliding bearing—and are consequently guided in a manner which is substantially contactless.

Figure 4:
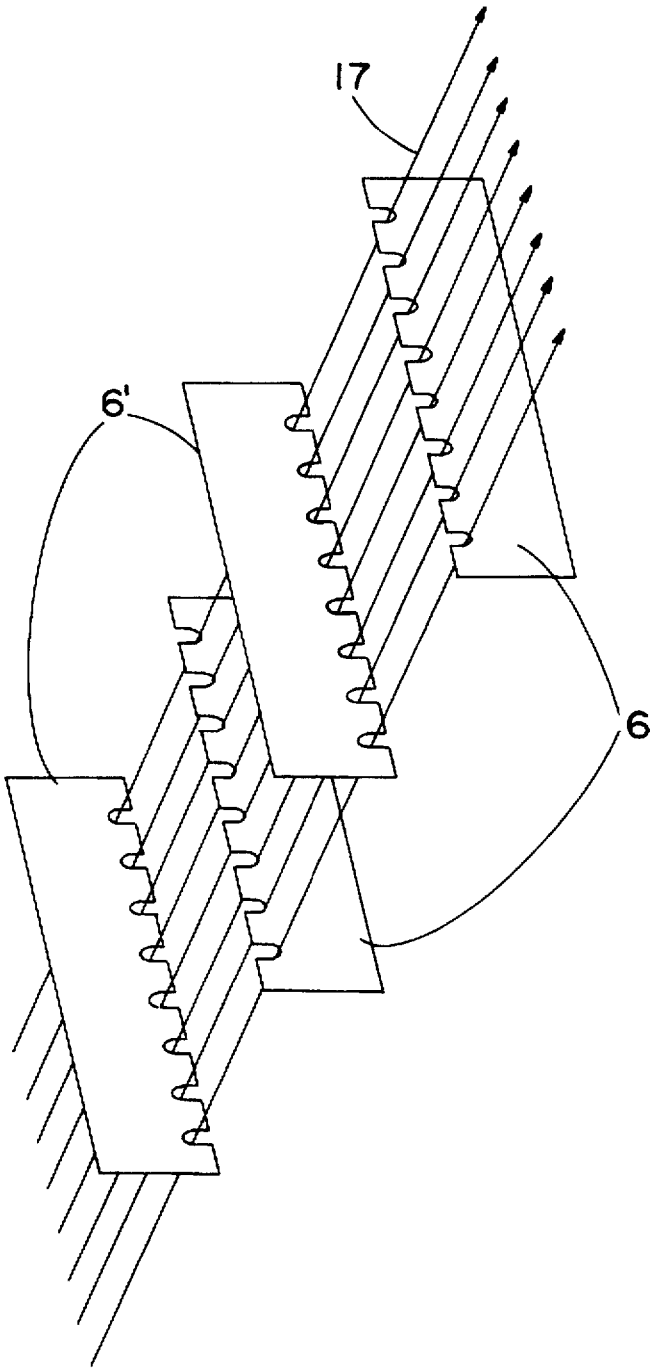
FIG. 4 shows preferred baffles according to the invention.

A liquid bath 3 having baffles 6, 6' is preferably utilised. The fluid flow caused by the drag flow of the filaments 17 is steadied by the baffles 6, 6' (see, for example, FIG. 4). The baffles 6 are disposed transversely to the direction of filament travel below and partially above the filament sheaf (see FIG. 4). The upper baffles 6' may be folded upward in order to lay on the filaments.

After emerging from the liquid bath 3 the entrained fluid (for example water) is removed from the filaments 17 by means of a wiper 7. Further entrained fluid is thrown off by deflecting the filaments at deflecting rollers 8. Notched rollers are preferably utilised for enhanced removal (throwing off) of the entrained water. Further entrained water remaining on the filaments is removed by the adherent water suction means 9. The spin finish is then applied to the filaments at the finish station 10 by a finishing roll or in a spray chamber having nozzles, and is evened out with a wiper.

It may be necessary to remove superfluous finish with a further adherent water suction means 11.

The filaments are then supplied, for example by way of a roll septet 12, to the drawing zone 13. The filaments are drawn, for example, in two stages in hot air at a temperature of from 240° to 260° C. and by a total of 420%.

Fixing takes place in the fixing zone 14 in hot air at, for example, from 250° to 260° C. The filaments are then wound on to the winding stations 15 at a winding speed of up to 4000 m/min.

EXAMPLES

Monofilaments are formed from pure polyamide-6 and copolyamide (85%. PA 6 with 15% PA 6.6) in accordance with the embodiment illustrated hereinabove. Prior to cooling in the liquid bath the monofilaments emerging from the spinning head are quenched with air (25° C.) in perpendicular manner directly below the spinneret.

The process parameters are shown in detail in Table 1 which follows.

The comparative Example is representative of the formation of polyamide-6 monofilaments in the current conventional manner.

TABLE 1

| Example No. | 1 | 2 | 3 | 4 | 5 | Comparative Example |
|---|---|---|---|---|---|---|
| Material | PA 6 | PA 6 | PA 6 | PA 6 | CPA 6.6/15 | PA 6 |
| Relative viscosity $\eta_{rel}$ | 3.1 | 3.1 | 3.1 | 4.0 | 4.0 | 3.1 |
| Monofilament diameter, μm | 200 | 200 | 100 | 200 | 200 | 200 |

TABLE 1-continued

| Example No. | 1 | 2 | 3 | 4 | 5 | Comparative Example |
|---|---|---|---|---|---|---|
| Spinneret diameter mm | 1.1 | 1.4 | 1 | 1.8 | 1.4 | 0.5 |
| Haul-off speed m/min | 230 | 490 | 910 | 476 | 258 | 75 |
| Cooling medium in in liquid bath | water | water | water | water | water | water |
| Temperature of cooling medium, °C. | 20 | 20 | 20 | 30 | 30 | 20 |
| 1st draw ratio | 3.4 | 3.4 | 3.2 | 3.5 | 4.46 | 3.4 |
| 2nd draw ratio | 1.176 | 1.2 | 1.2 | 1.2 | 1.3 | 1.26 |
| 1st hot air draw temperature | 240 | 250 | 250 | 250 | 250 | 170 |
| 2nd hot air draw temperature | 250 | 260 | 260 | 260 | 260 | 180 |
| Hot air fixing temperature | 250 | 260 | 260 | 260 | 260 | 185 |
| Winding speed m/min | 1000 | 2000 | 3500 | 2000 | 1500 | 322 |
| Properties of fibres obtained | | | | | | |
| Linear strength (cn/tex) | 52 | 50 | 47 | 55 | 71 | 54 |
| Max. tensile elongation (%) | 25 | 23 | 22 | 26 | 21 | 26 |
| Textile quality | 13 | 11.5 | 10.3 | 14.3 | 14.9 | 14 |
| Thermoshrinkage [%] at 150° C. | 9.5 | 9.5 | 9.5 | 9.5 | 14 | 9.5 |

We claim:

1. Apparatus for the continuous formation of monofilaments comprising a non-rotating melt-spinning head with spinneret (1), a blowing nozzle (2) supplying cooling gas towards a cooling zone of 1 to 10 cm, a liquid bath (3) having a specific filament guidance (4) therein for separately guiding the monofilaments through the liquid bath to prevent superficial contact between monofilaments while substantially in said bath, said specific filament guidance (4) comprising rod-shaped guidance elements (4') which are disposed in a semi circle and constructed such that, in operation at a filament speed of at least 600 m/min., the filaments slide over said guidance elements (4') through entrained liquid whereby there is substantially no contact between the filaments and the guidance elements (4'), an adherent liquid suction means (9, 11) upstream or downstream of, or both upstream and downstream of, the subsequent application (10) of the spin finish, one or more drawing apparatuses (13) for hot drawing, a fixing zone (14) and winding stations (15), wherein the post finish is applied in direct manner as a one-way finish at each bobbin station and the winding speed is from 600 m/min. to 4000 m/min., and the winding onto a bobbin is of single monofilaments, a plurality of monofilaments, or both.

2. Apparatus according to claim 1, wherein the rod-shaped guidance elements (4') have combs (16) which guide the filaments in single manner on the guidance elements.

3. Apparatus according to claim 1, further including baffles (6,6') wipers (7), and at least one deflecting roller (8) or notched groove roll for throwing off entrained cooling liquid from the liquid bath.

4. An apparatus for the continuous formation of a bobbin wound with a monofilament comprising a melt spinning head with spinneret (1) for extruding a molten filament, a blowing nozzle (2) for cooling the extruded molten filament, a liquid bath (3) having a specific filament guidance (4) therein for separately guiding the monofilaments through the bath to prevent superficial contact between the monofilaments so that the cooled filament passes into said bath, around said guidance, and exits from said bath, said specific filament guidance (4) comprising rod-shaped guidance elements (4') which are disposed in a semi circle and constructed such that, in operation at a filament speed of at least 600 m/min., the filaments slide over said guidance elements (4') through entrained liquid whereby there is substantially no contact between the filaments and the guidance elements (4'), means (10) for applying spin finish directly to the filament, upstream (9) of said finish applying means, downstream of said finish applying means or both, suction means for sucking off liquid from said filament, means (12, 13) for hot drawing and fixing the filament, and means (15) for winding the filament on a bobbin at a speed of from 600 to 4,000 meters per minute.

5. An apparatus according to claim 4, between the filament guidance (4) and said means (10) for applying spin finish further including baffles (6,6'), wipers (7) and at least one deflecting roller (8) or notched groove roll, so positioned that filaments passing around said filament guidance (4) pass over said baffles (6,6'), liquid from said bath adhering to said filaments is wiped therefrom by the wiper (7) and any entrained liquid still on the filaments is thrown off therefrom by roller (8) or the notched groove roll.

* * * * *